US009327948B2

(12) United States Patent
Seki et al.

(10) Patent No.: US 9,327,948 B2
(45) Date of Patent: May 3, 2016

(54) TELESCOPIC BOOM

(71) Applicant: TADANO LTD., Kagawa (JP)

(72) Inventors: Shogo Seki, Kagawa (JP); Toshiyuki Miyajima, Kagawa (JP)

(73) Assignee: TADANO LTD., Kagawa (JP)

( * ) Notice: Subject to any disclaimer, the term of this patent is extended or adjusted under 35 U.S.C. 154(b) by 51 days.

(21) Appl. No.: 14/270,680

(22) Filed: May 6, 2014

(65) Prior Publication Data

US 2014/0346132 A1 Nov. 27, 2014

(30) Foreign Application Priority Data

May 24, 2013 (JP) ..... 2013-109958

(51) Int. Cl.
*B66C 23/28* (2006.01)
*B66C 23/68* (2006.01)
*B66C 23/70* (2006.01)

(52) U.S. Cl.
CPC ..... *B66C 23/68* (2013.01); *B66C 23/705* (2013.01)

(58) Field of Classification Search
CPC ..... B66C 23/04; B66C 23/30; B66C 23/305; B66C 23/342; B66C 23/246; B66C 23/42; B66C 23/66; B66C 23/68; B66C 23/70; B66C 23/703; B66C 23/707
See application file for complete search history.

(56) References Cited

U.S. PATENT DOCUMENTS 3,426,917 A * 2/1969 Siegel ..... 212/264
3,831,771 A * 8/1974 Wiencek ..... 212/300
3,837,502 A * 9/1974 Hornagold ..... 212/349

FOREIGN PATENT DOCUMENTS

JP 3853149 B2 9/2006

* cited by examiner

*Primary Examiner* — Emmanuel M Marcelo
(74) *Attorney, Agent, or Firm* — Studebaker & Brackett PC

(57) ABSTRACT

A telescopic boom provided in a crane includes a boom body and a telescopic cylinder for extending/contracting the boom body. A roller is provided in a tip end portion of the telescopic cylinder to be rotatable in a longitudinal direction. A peripheral surface of the roller is formed to be curved (crowning) in a convex shape outside as viewed in the longitudinal direction and make contact with a lower plate of the boom body in a state where both corner parts are away from the lower plate.

7 Claims, 6 Drawing Sheets

TELESCOPIC BOOM

CROSS-REFERENCE TO RELATED APPLICATION

This application claims priority from Japanese Patent Application No. 2013-109958 filed on May 24, 2013, the disclosure of which is herein incorporated by reference.

BACKGROUND OF THE INVENTION

1. Field of the Invention

The present invention relates to a telescopic boom that is provided in a working vehicle, a crane and so on.

2. Description of the Related Art

There is known a telescopic boom in that the entire boom is telescopic, as a boom provided in a working vehicle, a crane and so on.

This telescopic boom is provided with a boom body that is telescopically formed in a longitudinal direction of the boom and in which a plurality of boom members are inserted in a telescopic manner from a base end of the boom body, and a telescopic cylinder that is positioned within a top boom member arranged in a tip end portion of the boom body at a completely contracted time of the boom body to extend and contract the boom body. A roller is rotatably provided at a tip end portion of the telescopic cylinder (for example, see Japanese Patent No. 3853149). The roller is in contact with a lower plate of the boom body and is configured to be capable of rolling on the lower plate in a longitudinal direction of the telescopic cylinder in accordance with the telescopic movement of the telescopic cylinder.

However, if the lower plate is formed to be thin in thickness for lightweight of the boom body, a bottom wall of the lower plate is deflected by a self-weight of the telescopic cylinder in the completely contracted and horizontal state of the boom body, and corners or peripheral edges of both ends of the roller collide with the lower plate.

Therefore, as the roller is inclined to the lower plate when a working vehicle vibrates at traveling, a peripheral surface of the roller makes point-contact with the lower plate to cause overconcentration of loads on the lower plate. In consequence, there is a possibility that a defect such as permanent deformation of the lower plate is brought about. When the deformation or the like is brought about in the lower plate, there is problem that the boom body cannot be smoothly extended or contracted.

SUMMARY OF THE INVENTION

An object of the present invention is to provide a telescopic boom that can effectively prevent a defect such as deformation of a lower plate in a boom body from being brought about at traveling of a working vehicle or at operating of the telescopic boom.

For achieving the above object, a telescopic boom according to an embodiment of the present invention includes a boom body provided in a working vehicle and in which a plurality of boom members including a top boom member are telescopically inserted and are formed to be moved telescopically in a longitudinal direction, a telescopic cylinder that is positioned in the top boom member at a completely contracted time of the boom body and extends/contracts the boom body, and at least a roller that is provided at a tip end portion of the telescopic cylinder and disposed to roll in the longitudinal direction.

The roller has an outer peripheral surface that is formed to be curved in a convex shape outside as viewed in the longitudinal direction such that the roller makes contact with a lower plate of the boom body in a state where both end portions of the roller are away from the lower plate.

DETAILED DESCRIPTION OF THE PREFERRED EMBODIMENTS

Embodiments of the present invention will be explained hereinafter in detail with reference to the accompanying drawings, FIG. 1 to FIG. 6.

Figure 1:
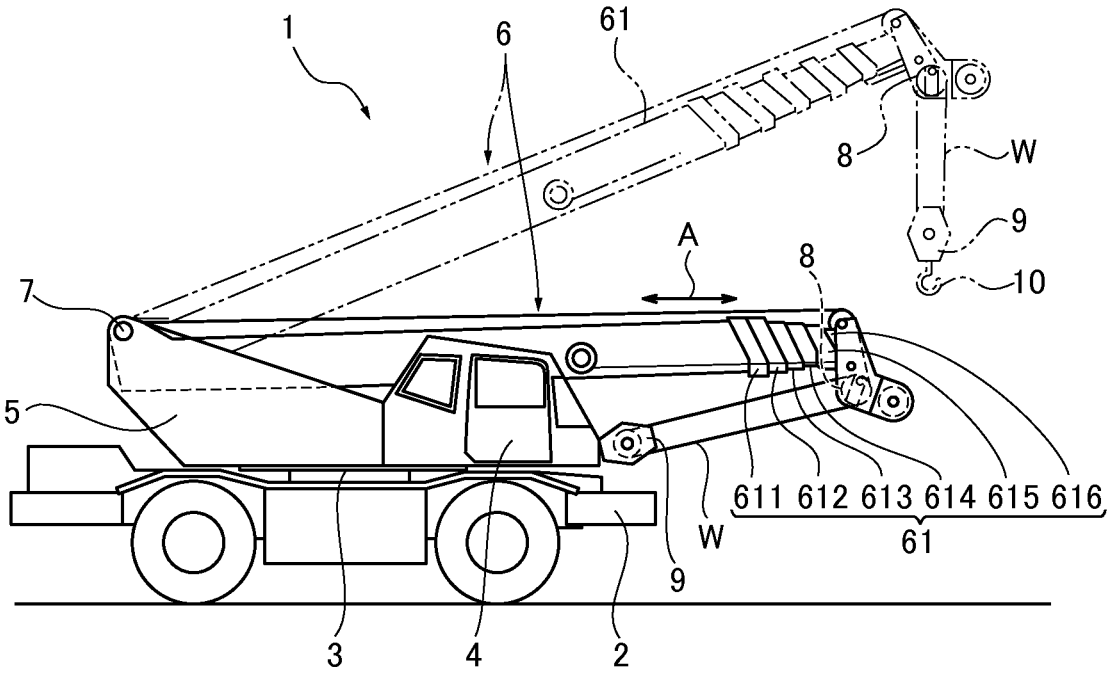
FIG. 1 is a right side view showing a crane provided with a telescopic boom according to an embodiment of the present invention.

FIG. 1 is a right side view of a crane 1 provided with a telescopic boom according to an embodiment of the present invention. First, an entire structure of the crane 1 will briefly be explained. This crane 1 is provided with a carrier 2 that is a body section (vehicle body) of a vehicle having a traveling function, a revolving platform 3 that is mounted on an upper portion of the carrier 2 to be capable of horizontally revolving, and an operator's room 4 that is provided in the revolving platform 3.

A pair of right and left outriggers (not shown) is provided respectively in a front side and rear side of the carrier 2. A boom bracket 5 is fixed on an upper side of the revolving platform 3. A telescopic boom 6 is mounted on the boom bracket 5.

The telescopic boom 6 is mounted at a base end portion thereof on the boom bracket 5 through a boom mounting pin 7, and is rotatable between a substantially horizontal state and a rising state of rising upward around the boom mounting pin 7. A lifting-falling cylinder (not shown) for lifting and falling the telescopic boom in an upper-lower direction is interposed between the boom bracket 5 and the telescopic boom 6. The telescopic boom 6 rotates between the horizontal state and the rising state around the boom mounting pin 7 in response to a telescopic operation of the lifting-falling cylinder.

A sheave 8 is provided in a tip end portion of the telescopic boom 6. A wire rope W extending from a winch (not shown) provided on the boom bracket 5 is wrapped around the sheave 8. A hook block 9 is suspended by the wire rope W, and a hook 10 is mounted on a lower side of the hook block 9. A load (not shown) is hung to the hook 10 through a sling wire rope (not shown).

An operating portion (not shown) is provided in the operator's room 4. The operating portion performs operations such as revolving of the revolving platform 3, up and down movement of the telescopic boom 6, hoisting and lowering of the winch, extension, contraction and storage of each outrigger, and start and stop of an engine and so on, by an operation of an operator.

Next, explanation will be made with respect to the telescopic boom 6. The telescopic boom 6 is well known, and will schematically be explained. The telescopic boom 6 is formed of, for example, a six-step boom assembly. The six-step boom assembly is provided with a boom body 61, and a telescopic mechanism for extending/contracting the boom body 61. The telescopic mechanism is provided with three telescopic cylinders, two extension wire rope mechanisms, and a contraction wire rope.

The boom body 61 includes a base boom member 611, a second boom member 612, a third boom member 613, a fourth boom member 614, a fifth boom member 615, and a top boom member 616 which are arranged in order from a base end side to a tip end portion of the boom body. The six boom members have cylindrical shapes outer diameters of which are different from each other, and are respectively inserted in a telescopic manner in the boom body 61 from the base end portion. The second boom member 612 to the base boom member 611, the third boom member 613 to the second boom member 612, the fourth boom member 614 to the third boom member 613, the fifth boom member 615 to the fourth boom member 614, and the top boom member 616 to the fifth boom member 615 are arranged to be respectively extensible in a longitudinal direction A of the boom body 61.

The three telescopic cylinders each are arranged (fixed) between the base boom member 611 and the second boom member 612, between the second boom member 612 and the third boom member 613 and between the third boom member 613 and the fourth boom member 614.

As will further specifically be explained, each telescopic cylinder is provided with, for example, a cylinder tube 62*a* (refer to FIG. 2) that is held by the top boom member in a top side, a piston (not shown) that is arranged in the cylinder tube 62*a* to be capable of sliding therein, and a rod (not shown) one end of which is fixed to the piston and the other of which is fixed to the base boom member in the base end portion. Each telescopic cylinder extends and contracts by movement of the cylinder tube 62*a* subjected to hydraulic pressures to extend and contract the top boom member.

That is, the telescopic cylinder in the base end portion that is fixed between the base boom member 611 and the second boom member 612 extends and contracts the second boom member 612 to the base boom member 611.

In addition, the intermediate telescopic cylinder that is fixed between the second boom member 612 and the third boom member 613 extends and contracts the third boom member 613 to the second boom member 612.

In addition, the telescopic cylinder 62 (refer to FIG. 2) in the tip end side that is fixed between the third boom member 613 and the fourth boom member 614 extends and contracts the fourth boom member 614 to the third boom member 613.

Figure 2:
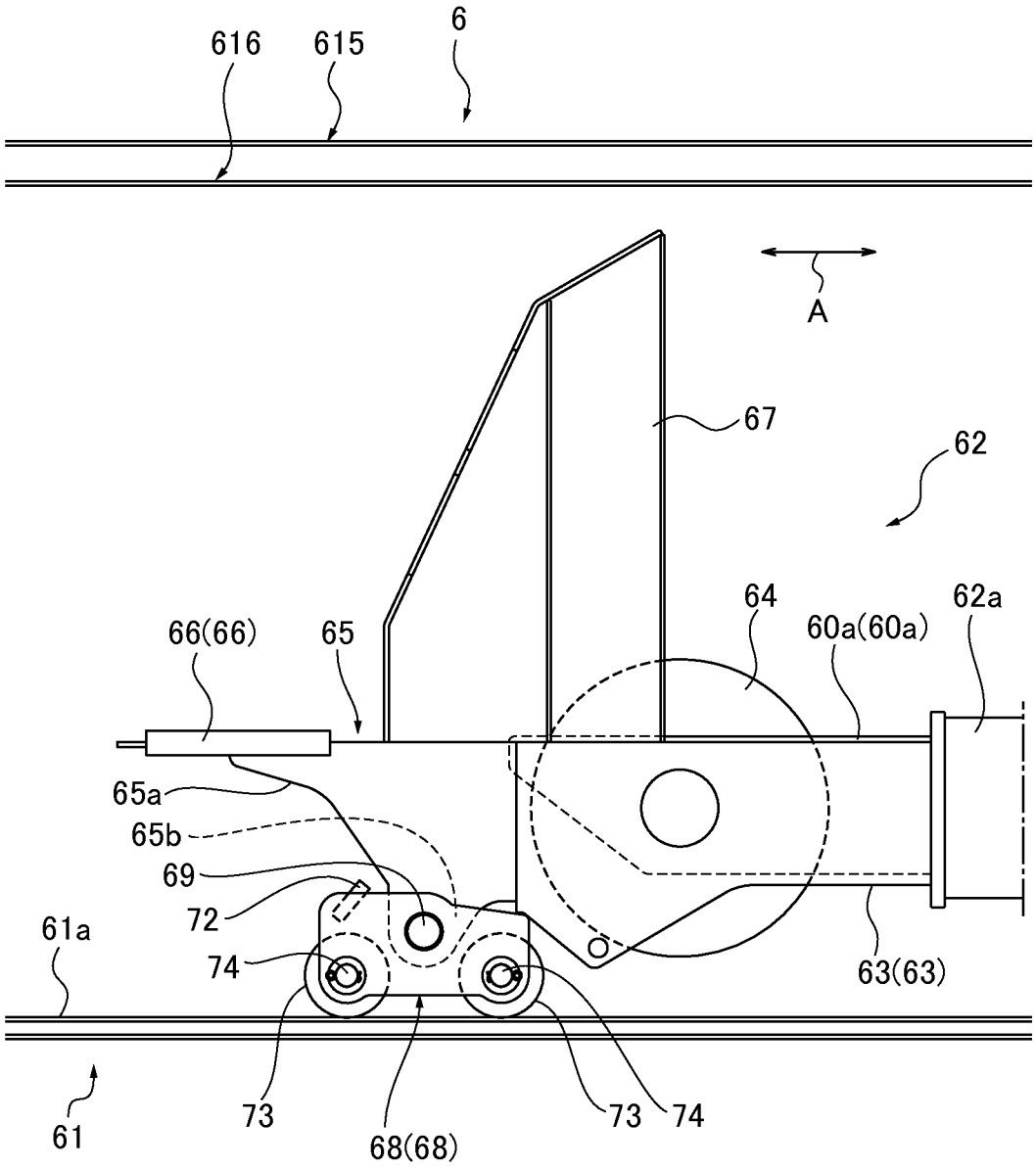
FIG. 2 is a left side view showing a tip end portion of a telescopic cylinder provided in the telescopic boom shown in the foregoing embodiment.

The two extension wire rope mechanisms each are provided with an extension sheave and an extension wire rope. As shown in FIG. 2, the extension sheave 64 in one of the extension wire rope mechanisms is rotatably mounted on a tip end portion of the telescopic cylinder 62 in the tip end side. The extension wire rope is put through the extension sheave 64 and both ends thereof are fixed to a tip end side of the third boom member 613 and a base end side of the fifth boom member 615. Thereby, when the telescopic cylinder 62 in the tip end side extends the fourth boom member 614, the fifth boom member 615 is extended.

The extension sheave in the other of the extension wire rope mechanisms is, although not shown, rotatably mounted to a tip end side of the fifth boom member 615. The extension wire rope is put through the extension sheave and both ends thereof are fixed to a tip end side of the fourth boom member 614 and a base end side of the top boom member 616. Thereby, when the telescopic cylinder 62 extends the fifth boom member 615, the top boom member 616 is extended.

The two contraction wire rope mechanisms each, although not shown, are provided with a contraction sheave and a contraction wire rope. The contraction sheave in one of the contraction wire rope mechanisms is rotatably mounted to the base end side of the fourth boom member 614. The contraction wire rope is put through the contraction sheave and both ends thereof are fixed to the tip end side of the third boom member 613 and the tip end portion of the fifth boom member 615. Thereby, when the telescopic cylinder 62 in the top end side contracts the fourth boom member 614, the fifth boom member 615 is contracted.

The contraction sheave in the other of the contraction wire rope mechanisms is rotatably mounted to the base end side of the fifth boom member 615. The contraction wire rope is put through the contraction sheave and both ends thereof are fixed to the tip side of the fourth boom member 614 and a tip end side of the top boom member 616. Thereby, when the telescopic cylinder 62 contracts the fifth boom member 615, the top boom member 616 is contracted.

It should be noted that the three telescopic cylinders 62 are placed in the order that the telescopic cylinder 62 in the tip end side is in the lowest position.

The telescopic cylinder 62 in the tip end side is, as shown in FIG. 2, positioned within the top boom member 616 at a completely contracted time of the boom body 61. Hereinafter, the configuration in the tip end portion of the telescopic cylinder 62 will be explained. It should be noted that in FIG. 2, the top boom member 616 and the fifth boom member 615 are shown in the boom body 61.

A pair of support members 63, 63 is provided in a tip end portion of the cylinder tube 62*a* in the telescopic cylinder 62 to be spaced in a right-left direction from each other. Sheave brackets 60*a*, 60*a* are arranged between the support members 63, 63 to be spaced in a right-left direction from each other. The aforementioned extension sheave 64 is arranged between the sheave brackets 60*a*, 60*a*. The extension sheaves 64 are mounted to the support members 63, 63 and the sheave brackets 60*a*, 60*a* to be rotatable in a longitudinal direction A. It should be noted that a portion in parentheses is not shown because it is in the right side. The same can be applied to the following explanation.

A support member 65 for bracket is provided at a tip end portion of each of the support members 63, 63. A tip end surface 65*a* of the support member 65 for bracket is formed to be recessed to the base end portion. Further, a mounting portion 65*b* is formed in a lower portion of the support member 65 for bracket to project downward.

Lateral guide members 66, 66 are provided in right and left tip sections of an upper portion of the support member 65 for bracket. An upper portion guide member 67 is provided to project from the upper portion of the bracket support member 65 over the upper portion between the support members 63, 63.

The lateral guide members 66, 66 and the upper portion guide members 67 guide the cylinder tube 62*a* to smoothly move in the longitudinal direction A of the boom body 61 when the cylinder tube 62*a* moves in the longitudinal direction A.

Figure 3:
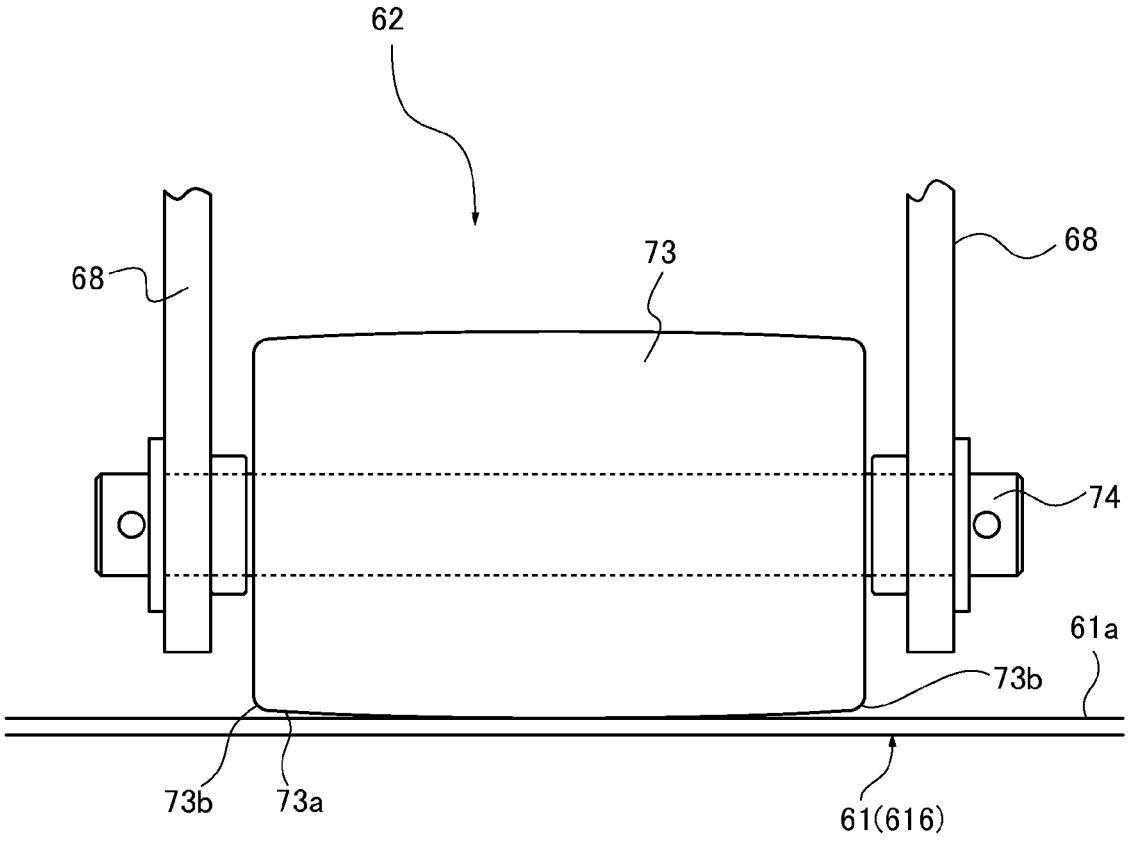
FIG. 3 is a front view showing brackets and a roller provided in a tip end portion of the telescopic cylinder shown in the foregoing embodiment.

A pair of brackets 68, 68 is provided in the right and left sides of the mounting portion 65*b* in the support member 65 for bracket to be capable of swinging in the longitudinal direction A by a swinging pin 69. The bracket 68 is formed in a plate shape as shown in FIG. 3.

A stopper 72 is provided in an upper portion of a tip end side of the brackets 68, 68 therebetween to be coupled to the brackets 68, 68. The stopper 72 is formed in a plate shape, and is arranged obliquely upward from the tip end side to the base end side.

The stopper 72 abuts against the tip surface 65*a* of the support member 65 for bracket when the tip sides of the brackets 68 are inclined upward, thus controlling each movement of the brackets 68, 68.

The two rollers 73, 73 are arranged tandemly in the longitudinal direction A between the brackets 68, 68. Each roller 73 is mounted to the brackets 68, 68 by the roller pin 74 to be rotatable in the longitudinal direction A.

In addition, through the rollers 73, 73, the tip portion of the telescopic cylinder 62 is supported to a lower plate 61*a* of the top boom 616. As shown in FIG. 3, an outer peripheral surface 73*a* of each roller 73 is formed to be curved (crowning) in a convex shape outside as viewed in a longitudinal direction and make contact with the lower plate 61*a* in a state where both corner portions 73*b*, 73*b* are away from the lower plate 61*a*. In other words, the outer peripheral surface of the roller 73 is formed to be curved along an axis line of the roller in such a manner that a central portion of the roller 73 rotates in contact with contact with the lower plate 61*a*.

The telescopic boom 6 configured as above is provided in a completely contracted and horizontal state in a solid line shown in FIG. 1 or as shown in FIG. 2 at traveling of the crane 1. Here, in the telescopic boom 6, a peripheral surface 73*a* of the roller 73 is curved in a convex shape outside as viewed in the longitudinal direction A, and both ends or both corner parts 73*b*, 73*b* are formed to be spaced from the lower plate 61*a*. Therefore, the peripheral surface 73*a* of the roller 73 has an intermediate part that makes surface contact with the lower plate 61*a*, which is close to point contact, and in consequence, both the corner parts 73*b*, 73*b* do not abut against the lower plate 61*a*.

Accordingly, even if the roller 73 is inclined to the lower plate 61*a* due to vibrations caused by rough roads or the like at traveling of the crane 1, since the peripheral surface 73*a* of the roller 73 do not make point contact with the lower plate 61*a*, the loads to be on the lower plate 61*a* are dispersed. Therefore, the telescopic boom 6 in the present embodiment can prevent a defect such as deformation of the lower plate 61*a* from being generated at traveling of the crane 1.

In addition, in the telescopic boom 6 of the present embodiment, a plurality of the rollers (two rollers) is provided in the tip end portion of the telescopic cylinder 62. Therefore, since a contact area of the rollers 73 to the lower plate 61*a* becomes larger as compared to a case of a single roller 73, the loads to be applied onto the lower plate 61*a* are dispersed in a wider range. In consequence, the telescopic boom 6 in the present embodiment can certainly prevent the defect such as deformation of the lower plate 61*a* from being generated at the time traveling of the crane 1. It should be noted that the number of the rollers 73 may be three or more.

In addition, when the boom body 61 extends from a completely contracted state shown in FIG. 2 as shown from FIG.2 to FIG. 4B and FIG. 4A, the telescopic cylinder 62 is stepped off from the top boom member 616 to the fifth boom member 615.

Here, as mentioned above, the brackets 68, 68 are provided in the tip end portion of the telescopic cylinder 62 to be swingable in the longitudinal direction A, and a plurality of the rollers 73 are arranged in the brackets 68, 68 tandemly in the longitudinal direction A.

Accordingly, when the telescopic cylinder 62 steps off, the load to be applied on each roller 73 is leveled by upward inclination of the tip side of each bracket 68. Therefore, the roller 73 in the base end side is securely supported by the fifth boom member 615, making it possible for the telescopic cylinder 62 to easily step off.

Figure 4B:
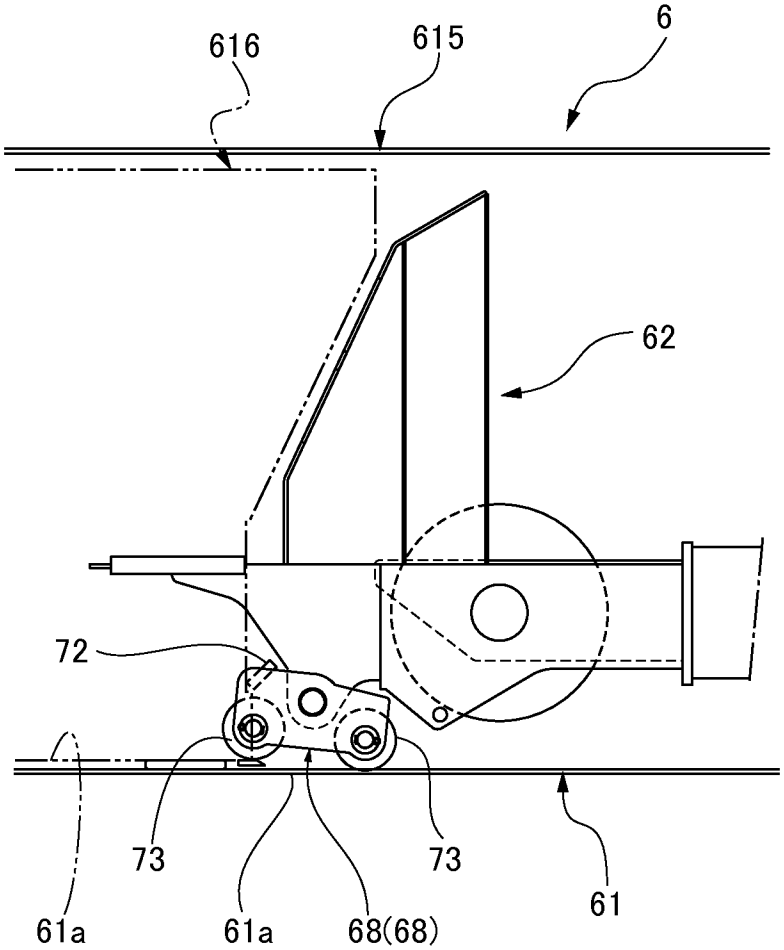
FIGS. 4A and 4B are diagrams showing the process of stepping-on and stepping-off of the telescopic cylinder shown in the foregoing embodiment.
Figure 4A:
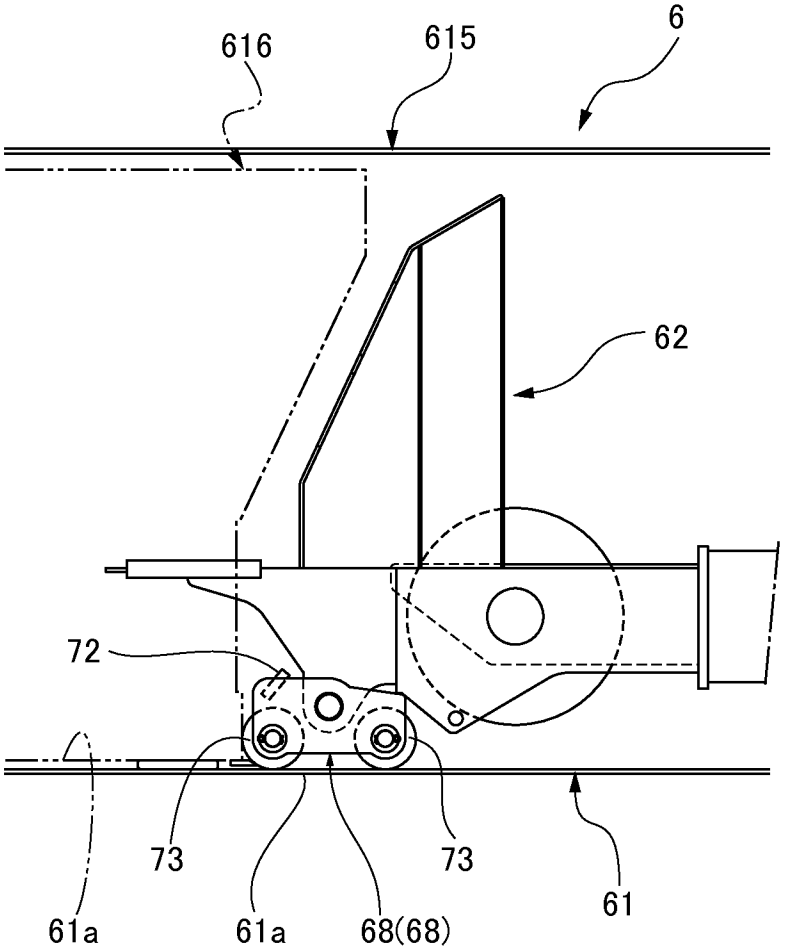

In addition, when the boom body 61 contracts from FIG. 4A to FIG. 4B, and FIG. 2, the telescopic cylinder 62 steps on from the fifth boom member 615 to the top boom member 616. At this time, the tip side of the bracket 68 is inclined upward, and thereby, the load to be applied on each roller 73 is leveled. In consequence, the telescopic cylinder 62 can easily step on. Accordingly, the telescopic boom 6 in the present embodiment can smoothly extends/contracts.

In addition, at stepping-on and stepping-off of the telescopic cylinder 62, the stopper 72 abuts against the tip surface 65*a* of the support member 65 for bracket to restrict the movement of the brackets 68, 68. Thereby, since the bracket 68 swings in an appropriate range, the telescopic cylinder 62 can smoothly step on and step off. Therefore, the telescopic boom 6 in the present embodiment can smoothly extend/contract.

In the telescopic boom in the present embodiment, the peripheral surface of the roller is formed to be curved in a convex shape outside as viewed in the longitudinal direction. Thereby, the peripheral surface of the roller makes surface contact with the lower plate and the corner part does not abut against the lower plate. Therefore, even if the roller is inclined to the lower plate due to vibrations generated at traveling of the working vehicle, since the peripheral surface of the roller does not make point contact with the lower plate, the load to be applied on the lower plate is dispersed. In consequence, the telescopic boom according to the present invention can prevent the defect such as deformation of the lower plate from being generated at traveling of the working vehicle.

The aforementioned embodiment does not limit the content of the present invention. In addition, the above embodiment may be altered variously within the range without departing from the scope as defined in claims of the present invention.

Figure 5:
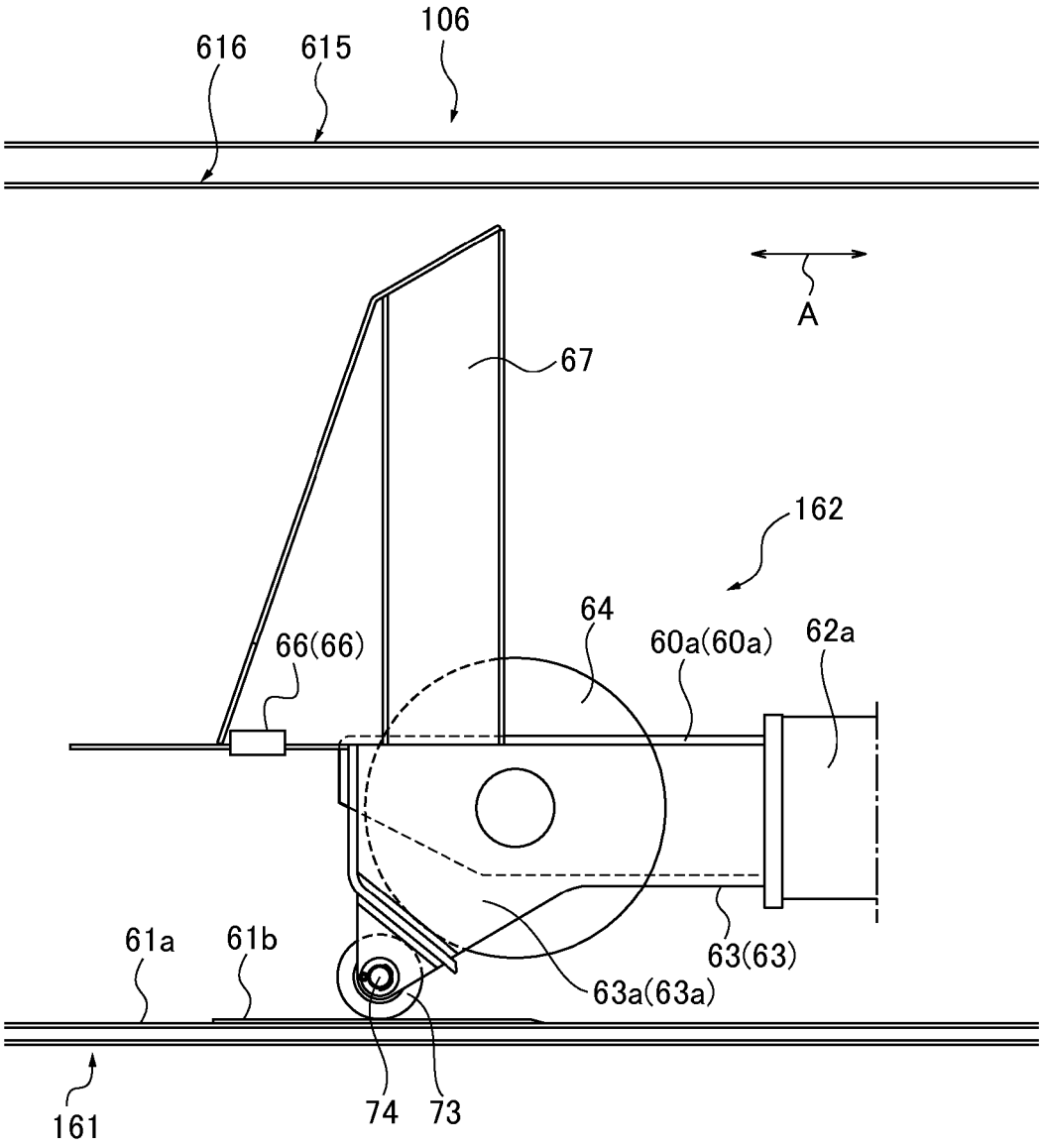
FIG. 5 is a left side view showing a tip end portion of a telescopic cylinder according to a different embodiment of the present invention.

For example, the two rollers 73 are provided in the telescopic boom 6 of the present embodiment, but the number of the rollers 73 is not limited particularly, and one piece of roller 73 may be provided as in the case of the telescopic boom 106 shown in FIG. 5.

Here, an explanation will be made of the configuration of the telescopic boom 106 as shown in FIG. 5. It should be noted that in FIG. 5, components identical to those in FIG. 2 are referred to as identical codes. An extension sheave 64 is rotatably mounted between support members 63, 63 (between sheave brackets 60*a*, 60*a*) in a tip portion of a cylinder tube 62*a* of a telescopic cylinder 162 in a tip side. Mounting portions 63*a*, 63*a* each are formed in a lower portion of a front part of each of the support members 63, 63 to project downward.

A single roller 73 is mounted between the mounting portions 63*a*, 63*a*. The roller 73 is mounted to the mounting portions 63*a*, 63*a* by a roller pin 74 to be rotatable in the longitudinal direction A.

In addition, in FIG. 5, as similar to FIG. 2, a boom body 161 is put in a completely contracted and horizontal state, and in a lower plate 61*a* of a top boom member 616 in the boom body 161, a reinforcement plate 61*b* is provided in a section (inner surface of the lower plate 61*a*) thereof with which the roller 73 makes contact to reinforce this section. In the telescopic boom 106, rigidity of the lower plate 61*a* is enhanced by the reinforcement plate 61*b*, and therefore, it is possible to certainly prevent a defect such as deformation of the lower plate 61*a* from being generated.

Figure 6:
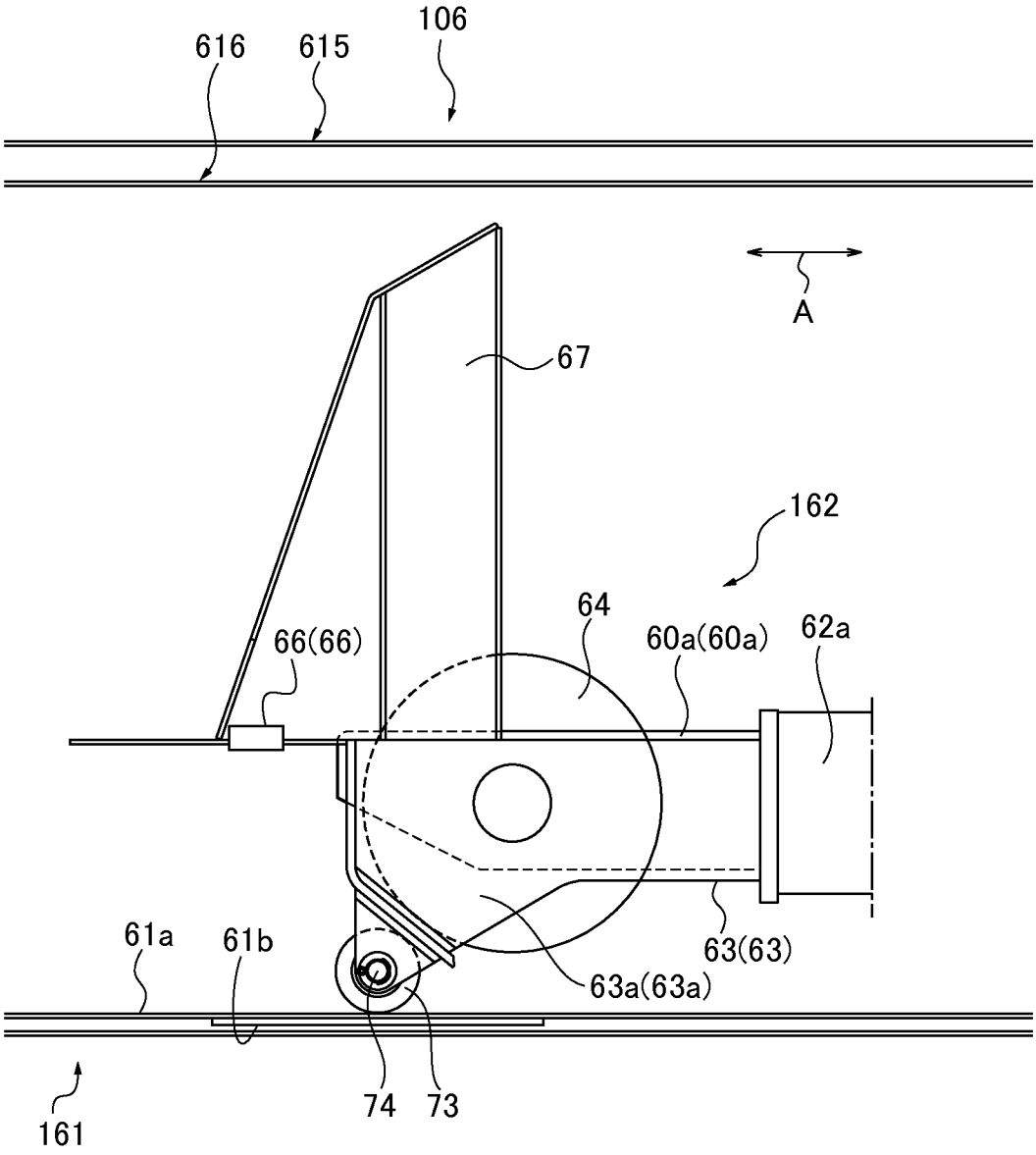
FIG. 6 is a left side view showing a tip end portion of a telescopic cylinder according to a further different embodiment of the present invention.

In addition, as in the case of a telescopic boom 206 in FIG. 6, in a lower plate 61*a* of a top boom member 616 in a boom body 261, a reinforcement plate 61*b* may be provided in a section (outer surface of the lower plate 61*a*) thereof with which the roller 73 makes contact to reinforce this section. It should be noted that in FIG. 6, components identical to those in FIG. 5 are referred to as identical codes.

In addition, in the telescopic boom 6 in the present embodiment, the two rollers 73 are provided tandemly in the longitudinal direction A of the boom body 61, but may be provided laterally in the width direction of the boom body 61.

In addition, in the present embodiment, the telescopic boom 6 is formed of the three telescopic cylinders 62, but the telescopic boom according to the present invention is not limited to the telescopic boom 6 shown in the present embodiment. For example, the pre sent invention may be applied to a two or more-step telescopic boom that at least one telescopic cylinder is positioned in a top boom member, and the tip portion is provided with a roller which makes contact with a lower plate of a boom body.

Although the preferred embodiments of the present invention have been described, the present invention is not limited to these embodiments, any modifications and changes can be made to the foregoing embodiments as long as the modifications and the changes are within the scope of the appended Claims.

What is claimed is:

1. A telescopic boom comprising:

a boom body provided in a working vehicle and in which a plurality of boom members including a top boom member are telescopically inserted and are formed to be moved telescopically in a longitudinal direction;

a telescopic cylinder that is positioned in the top boom member at a completely contracted time of the boom body and extends/contracts the boom body; and at least a roller that is provided at a tip end portion of the telescopic cylinder and disposed to roll in the longitudinal direction, wherein the roller has an outer peripheral surface formed to be curved in a convex shape outside along an axis of the roller perpendicular to the longitudinal direction and including an intermediate portion which is in contact with a lower plate of the boom body and both end portions which are provided on both sides of the intermediate portion and are away from the lower plate.

2. A telescopic boom according to claim 1, wherein a plurality of the rollers are provided at the tip end portion of the telescopic cylinder.

3. A telescopic boom according to claim 2, further comprising a bracket that is mounted at the tip end portion of the telescopic cylinder and is swingably provided in a longitudinal direction of the boom body, wherein the plurality of the rollers are provided on the bracket and are arranged in the longitudinal direction of the boom body.

4. A telescopic boom according to claim 3, further comprising a reinforcement plate provided to reinforce a portion of the lower plate where the rollers are in contact with the lower plate of the top boom member in a state where the boom body is completely contracted and horizontal.

5. A telescopic boom according to claim 2, further comprising a reinforcement plate provided to reinforce a portion of the lower plate where the rollers are in contact with the lower plate of the top boom member in a state where the boom body is completely contracted and horizontal.

6. A telescopic boom according to claim 1, further comprising a reinforcement plate provided to reinforce a portion of the lower plate where the roller is in contact with the lower plate of the top boom member in a state where the boom body is completely contracted and horizontal.

7. A telescopic boom comprising:

a boom body provided in a working vehicle and in which a plurality of boom members including a top boom member are telescopically inserted and are formed to be moved telescopically in a longitudinal direction;

a telescopic cylinder that is positioned in the top boom member at a completely contracted time of the boom body and extends/contracts the boom body;

a plurality of rollers that are provided at a tip end portion of the telescopic cylinder and disposed to roll in the longitudinal direction; and a bracket that is mounted at the tip end portion of the telescopic cylinder and is swingably provided in the longitudinal direction of the boom body, wherein the plurality of rollers are provided on the bracket and are arranged in the longitudinal direction of the boom body, wherein each of the plurality of rollers has an outer peripheral surface that is formed to be curved in a convex shape outside as viewed in the longitudinal direction such that the roller makes contact with a lower plate of the boom body in a state where both end portions of the roller are away from the lower plate.

* * * * *